US008090139B2

(12) United States Patent
Reinecke

(10) Patent No.: US 8,090,139 B2
(45) Date of Patent: Jan. 3, 2012

(54) DIAPHRAGM FOR AN ELECTROACOUSTIC TRANSDUCER, AND ELECTROACOUSTIC TRANSDUCER

(76) Inventor: Benjamin Reinecke, Baden (AT)

( * ) Notice: Subject to any disclaimer, the term of this patent is extended or adjusted under 35 U.S.C. 154(b) by 979 days.

(21) Appl. No.: 11/993,650

(22) PCT Filed: Jun. 14, 2006

(86) PCT No.: PCT/IB2006/051908

§ 371 (c)(1),
(2), (4) Date: Jan. 28, 2008

(87) PCT Pub. No.: WO2007/000678

PCT Pub. Date: Jan. 4, 2007

(65) Prior Publication Data

US 2010/0158304 A1 Jun. 24, 2010

(30) Foreign Application Priority Data

Jun. 29, 2005 (EP) ..... 05105821

(51) Int. Cl.
*H04R 25/00* (2006.01)

(52) U.S. Cl. ..... 381/396; 381/423

(58) Field of Classification Search ..... 381/396, 381/423, 424, 398

See application file for complete search history.

(56) References Cited

U.S. PATENT DOCUMENTS 2,685,935 A 8/1954 Lenz
2003/0133586 A1* 7/2003 Ko ..... 381/410
2003/0231784 A1* 12/2003 Kuze et al. ..... 381/386
2007/0009133 A1* 1/2007 Gerkinsmeyer ..... 381/398
2007/0183619 A1* 8/2007 Kuribayashi ..... 381/396
2008/0063235 A1* 3/2008 Takewa ..... 381/412
2008/0247595 A1* 10/2008 Henry ..... 381/398
2008/0273740 A1* 11/2008 Takewa ..... 381/412

FOREIGN PATENT DOCUMENTS

JP 60244190 A 12/1985
JP 61113397 A 5/1986
JP 2005203832 A 7/2005

* cited by examiner

*Primary Examiner* — Savitr Mulpuri

(57) ABSTRACT

A diaphragm (6) for an electroacoustic transducer is preferably designed to be essentially rectangular and has a diaphragm inner region (20) for sound conversion and a diaphragm outer region (21) for attaching the diaphragm (6) and a diaphragm intermediate region (22) which lies between the diaphragm inner region (20) and the diaphragm outer region (21), wherein the diaphragm inner region (20) is delimited toward the outside by preferably rectilinear sides (23, 24, 25, 26) and the diaphragm outer region (21) is delimited toward the inside again by preferably rectilinear sides (31, 32, 33, 34), and wherein the aforementioned sides (23, 24, 25, 26) of the diaphragm inner region (20) are joined to rounded outer corner regions (27, 28, 29, 30) with a mean outer radius value R and the aforementioned sides (31, 32, 33, 34) of the diaphragm outer region (21) are joined to rounded inner corner regions (35, 36, 37, 38) with a mean inner radius value r, wherein the mean inner radius value r of each inner corner region (35, 36, 37, 38) is smaller than the mean outer radius value R of the opposite outer corner region (27, 28, 29, 30).

7 Claims, 2 Drawing Sheets

DIAPHRAGM FOR AN ELECTROACOUSTIC TRANSDUCER, AND ELECTROACOUSTIC TRANSDUCER

FIELD OF THE INVENTION

The invention relates to a diaphragm for an electroacoustic transducer, wherein the diaphragm has a diaphragm inner region and a diaphragm outer region and a diaphragm intermediate region which connects the diaphragm inner region and the diaphragm outer region, and wherein the diaphragm inner region is provided for converting between sound waves and electrical signals, and wherein the diaphragm outer region is provided for attaching the diaphragm, and wherein the diaphragm inner region is delimited toward the outside by a certain number of sides which adjoin the diaphragm intermediate region and between in each case two neighboring sides has a rounded outer corner region with a mean outer radius value, and wherein the diaphragm outer region is delimited toward the inside by the same number of sides which adjoin the diaphragm intermediate region and between in each case two neighboring sides has a rounded inner corner region with a mean inner radius value, and wherein each inner corner region lies opposite an outer corner region.

The invention also relates to an electroacoustic transducer comprising a diaphragm of the type described in the first paragraph above.

BACKGROUND OF THE INVENTION

A diaphragm of the type described in the first paragraph above and an electroacoustic transducer comprising such a diaphragm are known for example from patent document JP 60-244.190 A. In the known diaphragm, the mean inner radius value of each inner corner region is greater than the mean outer radius value of the opposite outer corner region. Such a design is customary in general, but has disadvantages with regard to achieving the best possible acoustic properties of such a diaphragm and consequently the best possible properties of an electroacoustic transducer comprising such a diaphragm.

OBJECT AND SUMMARY OF THE INVENTION

The object of the invention is to improve the mode of action and the properties of a diaphragm of the type described in the first paragraph and of an electroacoustic transducer comprising such a diaphragm.

To achieve the object described above, a diaphragm according to the invention is provided with features according to the invention so that a diaphragm according to the invention can be characterized as follows, namely:

A diaphragm for an electroacoustic transducer, wherein the diaphragm has a diaphragm inner region and a diaphragm outer region and a diaphragm intermediate region which connects the diaphragm inner region and the diaphragm outer region, and wherein the diaphragm inner region is provided for converting between sound waves and electrical signals, and wherein the diaphragm outer region is provided for attaching the diaphragm, and wherein the diaphragm inner region is delimited toward the outside by a certain number of sides which adjoin the diaphragm intermediate region and between in each case two neighboring sides has a rounded outer corner region with a mean outer radius value, and wherein the diaphragm outer region is delimited toward the inside by the same number of sides which adjoin the diaphragm intermediate region and between in each case two neighboring sides has a rounded inner corner region with a mean inner radius value, and wherein each inner corner region lies opposite an outer corner region, and wherein the inner corner regions and the outer corner regions have the same direction of curvature, characterized in that the mean inner radius value r of each inner corner region is smaller than the mean outer radius value R of the opposite outer corner region.

To achieve the object described above, in an electroacoustic transducer according to the invention, it is provided that the electroacoustic transducer according to the invention is provided with a diaphragm according to the invention.

Providing the features according to the invention means that, in a simple manner and with virtually no additional outlay in terms of material and manufacture, it is possible to achieve an improved, that is to say an increased, stiffness of the diaphragm in the area of the inner corner regions by making the mean inner radius value of each inner corner region smaller than the mean outer radius value of the opposite outer corner region, said increased stiffness being advantageous with regard to as little wobbling (or rocking) as possible of the vibrating regions of the diaphragm. It is also achieved in the diaphragm according to the invention that, due to the radius ratios according to the invention, the moving surface which is crucial for producing the generated sound pressure is larger than in the case of a diaphragm according to the prior art, since the section of the diaphragm intermediate region located between a respective outer corner region and an opposite inner corner region has a larger dimension in the radial directions than is the case in the design of a diaphragm according to the prior art.

A rounded outer corner region with a mean outer radius value and a rounded inner corner region with a mean inner radius value means that the outer corner region and the inner corner region need not necessarily be rounded in the manner of a single circular arc, which has just a single outer radius value or inner radius value, but rather can also be rounded in accordance with an elliptical, parabolic or other such profile, wherein radius values of different size then exist along the profile, the mathematical mean of which is the mean outer radius value or mean inner radius value. In this case, it is important that the inner corner regions and the outer corner regions have the same direction of curvature.

In connection with the fact that, in a diaphragm according to the invention, the inner corner regions and the outer corner regions have the same direction of curvature, mention is made of patent document U.S. Pat. No. 2,685,935 and particular reference is made to FIG. 9 of said patent document. This FIG. 9 shows an embodiment of a diaphragm, in which diaphragm the diaphragm intermediate region between an inner corner region and an outer corner region has a larger radial dimension than in the sections lying between two sides running parallel to one another. In this case, however, each outer corner region consists of two curved sections which have a different direction of curvature than the opposite inner corner region, namely the opposite direction of curvature, and which form a point with one another which points away from the opposite inner corner region, which brings considerable disadvantages. It is disadvantageous that, due to the point in the diaphragm outer region, a smaller fixing surface is available for attachment of the diaphragm and that, due to the point which exists, higher mechanical stresses arise in the diaphragm, which brings the risk of tears forming in the diaphragm—particularly in the case of a diaphragm made of a very thin material—and the risk of acoustic distortions, which acoustic distortions are unfavorable with regard to the best possible playback quality.

In a diaphragm according to the invention, the ratio between a mean outer radius value R of an outer corner region and a mean inner radius value r of the opposite inner corner region can lie within a large ratio range. In practice, it has proven advantageous if, for a mean outer radius value R of an outer corner region, the mean inner radius value r of the opposite inner corner region lies in a range of values between $$R - \frac{R}{100} \text{ and } \frac{R}{100}.$$

Such an embodiment has proven advantageous with regard to simple and reproducible automated manufacture and also with regard to the highest possible mechanical stability of a diaphragm according to the invention. Furthermore, such an embodiment is advantageous with regard to the shape of a voice coil which is mechanically connected to the diaphragm according to the invention, which voice coil has coil regions which are rounded in a manner corresponding to the shape of the diaphragm and are positioned directly adjacent to the rounded outer corner regions of the diaphragm inner region of the diaphragm, since, in this voice coil, the rounded coil regions have radius of curvature values which essentially correspond to the mean outer radius values of the rounded outer corner regions, that is to say are relatively large, which is advantageous with regard to a trouble-free winding operation for producing the voice coil and with regard to the lowest possible mechanical stresses in the rounded coil regions.

It has proven to be particularly advantageous if the embodiment is selected such that the mean inner radius value r has a value of $$R - \frac{R}{4}.$$

Such an embodiment has proven advantageous after carrying out a large number of test series during the development of a diaphragm according to the invention. In such an embodiment, it is especially advantageous that a very good compromise is reached between on the one hand the smallest possible mean inner radius value and on the other hand the highest possible resistance to tearing of the diaphragm in the inner corner regions.

A diaphragm according to the invention can have three, five, six or even more inner corner regions and a corresponding number of outer corner regions. It has proven to be particularly advantageous if four inner corner regions and four outer corner regions are provided. This embodiment is known per se from the prior art, but has also proven to be particularly advantageous in a diaphragm according to the invention.

In a diaphragm according to the invention, it has also proven to be advantageous if the sides which run between the inner corner regions and the outer corner regions are rectilinear. This embodiment too is known per se from the prior art, but has also proven to be advantageous in a diaphragm according to the invention. It should be mentioned that the sides running between the inner corner regions and the outer corner regions do not necessarily have to be rectilinear, but rather they may also take a slightly convex or a slightly concave course. It is also possible for the sides running between two inner corner regions to be convex and at the same time for the sides lying between two outer corner regions to be concave.

In a diaphragm according to the invention, the inner corner regions can have different inner radius values. The outer corner regions can also have different outer radius values. However, it has proven to be particularly advantageous if all the mean inner radius values of the inner corner regions are the same size and all the mean outer radius values of the outer corner regions are the same size.

It should be mentioned at this point that the diaphragm intermediate region of a diaphragm according to the invention can have different cross-sectional shapes. One preferred cross-sectional shape is U-shaped, wherein then the diaphragm intermediate region is designed in the manner of a tunnel or trough or channel. In the case of a tunnel-like design, a constantly uniform tunnel height may be provided. In the case of trough-like or channel-like design, a constantly uniform trough depth or channel depth may be provided. However, it is not absolutely necessary for a tunnel height or trough depth or channel depth always to have the same value along the diaphragm intermediate region, since varying values of a tunnel height or trough depth or channel depth can also be provided.

An electroacoustic transducer according to the invention may be designed as a microphone. It has proven to be advantageous if an electroacoustic transducer according to the invention is designed as a loudspeaker, since the advantages of a diaphragm according to the invention are particularly advantageous in the case of a loudspeaker.

The above aspects and further aspects of the invention emerge from the example of embodiment described above and are explained on the basis of this example of embodiment.

BRIEF DESCRIPTION OF THE DRAWINGS

The invention will be further described with reference to an example of embodiment shown in the drawings to which, however, the invention is not restricted.

DESCRIPTION OF EMBODIMENTS

Figure 1:
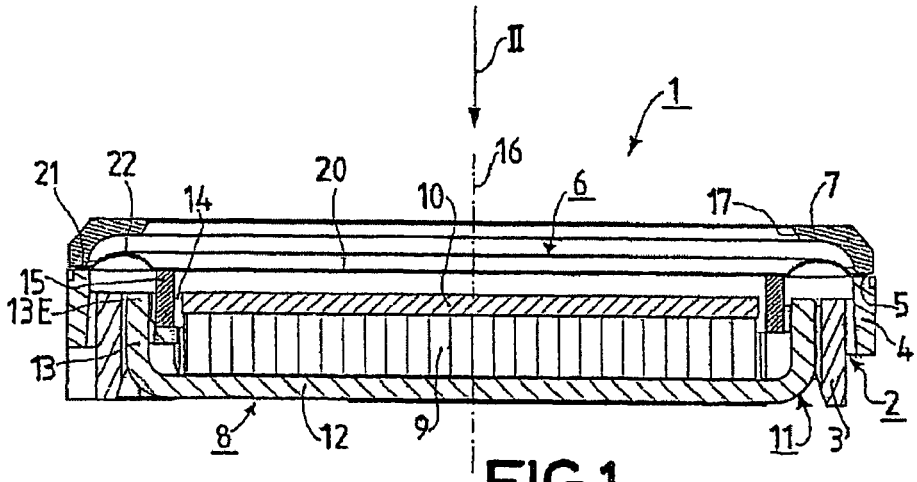
FIG. 1 shows, in a section along the line I-I in FIG. 2, an electroacoustic transducer according to the invention, specifically a loudspeaker.
Figure 2:
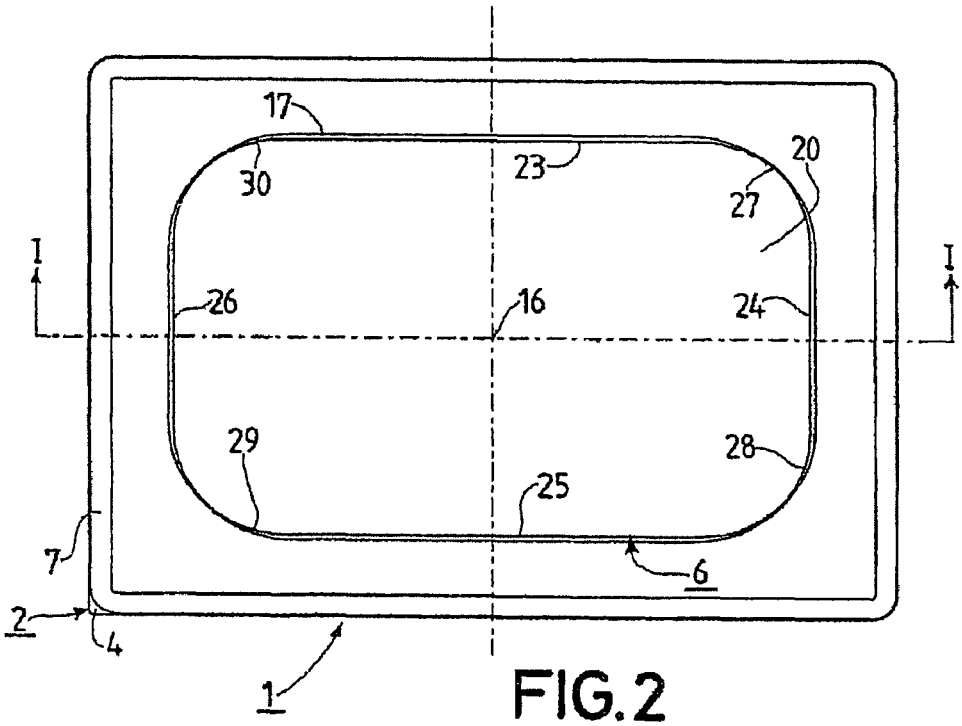
FIG. 2 shows, in a view from above as shown by the arrow II in FIG. 1, the electroacoustic transducer according to FIG. 1.

FIGS. 1 and 2 show an electroacoustic transducer 1 which is designed as a loudspeaker. The electroacoustic transducer 1 will be referred to below as transducer 1 for short. The transducer 1 is designed according to the invention, as will be discussed in more detail below. The transducer 1 has essentially a rectangular shape, but with rounded corner regions instead of sharp corners.

The transducer 1 has a housing 2. The housing 2 consists of an inner housing region 3 which is essentially hollow-cylindrical, and of an outer housing region 4 which is also essentially hollow-cylindrical, wherein the two housing regions 3 and 4 each have an essentially rectangular cylinder base. The two housing regions 3 and 4 are made of plastic and are produced in one piece. The outer housing region 4 has an annular fixing flange 5 which corresponds to the rectangular shape of the transducer 1 and is provided for attaching a diaphragm 6 of the transducer 1. In order to protect the diaphragm 6 and cover the diaphragm 6 and the front side of the transducer 1, the housing 2 has a cover 7 which sits on the fixing flange 5 with the interposition of a section (hereinafter referred to as the diaphragm outer region) of the diaphragm 6 and is connected to the outer housing region 4. The connection of the diaphragm 6 to the outer housing region 4 and the connection of the cover 7 to the outer housing region 4 is in the present case achieved by an adhesive connection. However, other types of connection are possible, for example connections produced by laser welding.

Inside the inner housing region 3, the transducer 1 contains a magnet system 8. The magnet system 8 is provided with a permanent magnet 9 and with a circular plate-shaped first yoke 10 and with a pot-shaped second yoke 11. The second yoke 11 consists of a plate-shaped bottom part 12 and of a hollow-cylindrical edge part 13 which is connected in one piece to the bottom part 12. An air gap 14 is formed between the end 13E of the edge part 13 which faces away from the bottom part 12 and the circular plate-shaped first yoke 10. A voice coil 15 is arranged in the air gap 14. The voice coil 15 is connected to the diaphragm 6 by means of an adhesive connection. During operation of the transducer, wherein electrical signals from an audio signal source (not shown) are fed to the voice coil 15, said voice coil 15 executes vibrating movements parallel to the transducer axis 16, as is known in general. On account of the vibrating movements of the voice coil 15, electrical signals fed to the voice coil 15 are converted into sound waves by part (diaphragm inner region+inner areas of a diaphragm intermediate region) of the diaphragm 6, which sound waves are output through an opening 17 in the cover 7 of the transducer 1.

In the text which follows, the diaphragm 6 of the transducer 1 will be described in more detail with reference to FIGS. 3, 4 and 5.

The diaphragm 6 has a diaphragm inner region 20 and a diaphragm outer region 21 and a diaphragm intermediate region 22 which connects the diaphragm inner region 20 and the diaphragm outer region 21.

In the diaphragm 6, the diaphragm inner region 20 is essentially flat. This need not necessarily be the case, since the diaphragm inner region 20 can also be designed to be slightly concave or slightly convex. It should also be mentioned that it may be advantageous to connect the diaphragm inner region 20 to a flat plate-shaped stiffening element, wherein this stiffening element may be provided either on the side of the diaphragm inner region 20 which faces away from the magnet system 8 or on the side of the diaphragm inner region 20 which faces toward the magnet system 8. Such a stiffening element is connected to the diaphragm inner region 20 preferably by means of an adhesive connection. The diaphragm inner region 20 is provided for converting between sound waves and electrical signals, wherein, in the present case in which the diaphragm 6 is used in a transducer 1 designed as a loudspeaker, the diaphragm inner region 20 is provided and used for converting electrical signals into sound waves.

In the present case of the diaphragm 6, the diaphragm outer region 21 is also designed to be flat like the diaphragm inner region 20. The diaphragm outer region 21 has an annular shape, wherein the annular shape is essentially rectangular, with rounded corner regions being provided between the sides of the rectangle. The diaphragm outer region 21 is provided for attaching the diaphragm 6. In the transducer 1, the diaphragm outer region 21 is connected to the annular fixing flange 5 of the outer housing region 4 by an adhesive connection, as already described in other words above.

In the diaphragm 6, the diaphragm intermediate region 22 is designed to be curved in cross section, so that the diaphragm intermediate region 22 has a tunnel-like design overall, that is to say has a tunnel shape. In this case, the design of the diaphragm intermediate region 22 is such that there is always a constant uniform tunnel height H over the entire course of the diaphragm intermediate region 22, as shown in FIG. 5.

The diaphragm inner region 20 is delimited toward the outside by a certain number of sides which adjoin the diaphragm intermediate region 22, and specifically in the present case by four (4) sides 23, 24, 25, 26 which adjoin the diaphragm intermediate region 22, all four sides being rectilinear. The diaphragm inner region 20 has a rounded outer corner region 27, 28, 29, 30 between in each case two neighboring sides 23, 24 and 24, 25 and 25, 26 and 26, 23. The outer corner regions 27, 28, 29, 30 have a mean outer radius value R, wherein this is the radius value of a circular arc in the diaphragm 6 according to FIGS. 3, 4 and 5. However, the rounded areas between two respective sides 23, 24 and 24, 25 and 25, 26 and 26, 23 need not necessarily be defined by a circular arc, but rather can also have a different arc shape, for example an elliptical or parabolic arc.

The diaphragm outer region 21 is delimited toward the inside by the same number of sides which adjoin the diaphragm intermediate region 22, and specifically in the present case by four (4) sides 31, 32, 33, 34 which adjoin the diaphragm intermediate region 22, all four sides being rectilinear. The diaphragm outer region 21 has a rounded inner corner region 35, 36, 37, 38 between in each case two neighboring sides 31, 32 and 32, 33 and 33, 34 and 34, 31. The four inner corner regions 35, 36, 37, 38 have a mean inner radius value r, which is formed by the radius value of a circular arc in the present case of the diaphragm 6. In the case of the rounded inner corner regions 35, 36, 37, 38, too, these inner corner regions need not necessarily be defined by the shape of the circular arc, but rather can also have a different arc shape.

Figure 4:
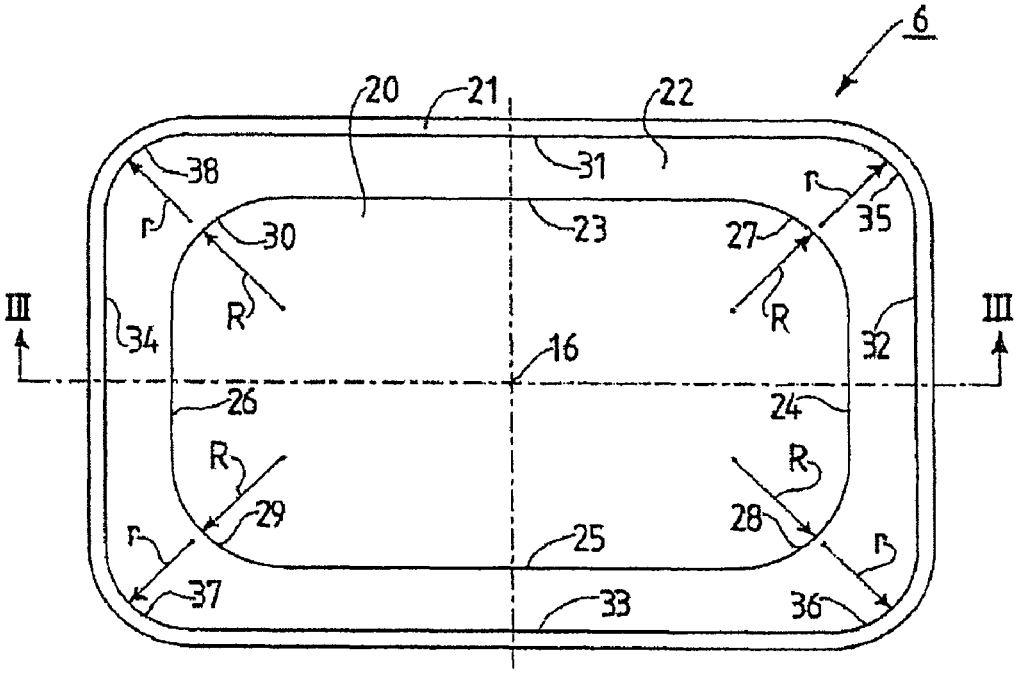
FIG. 4 shows, in a view from above as shown by the arrow IV in FIG. 3, the diaphragm according to FIG. 3.

As can clearly be seen from FIG. 4, each inner corner region 35, 36, 37, 38 lies opposite an outer corner region 27, 28, 29, 30 and the inner corner regions 35, 36, 37, 38 and the outer corner regions 27, 28, 29, 30 have the same direction of curvature. Having the same direction of curvature means in other words that the mean outer radius vector of an outer corner region 27, 28, 29, 30 and the mean inner radius vector of the adjacent inner corner region 35, 36, 37, 38 point in the same direction.

Figure 3:
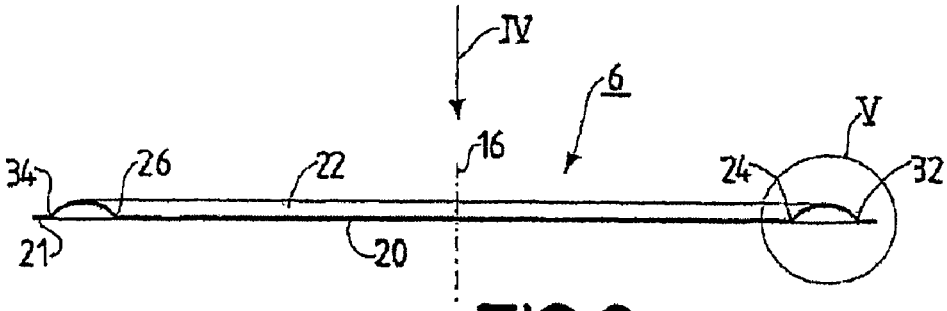
FIG. 3 shows, in a manner analogous to FIG. 1 and in a section along the line III-III in FIG. 4, the diaphragm of the electroacoustic transducer according to FIGS. 1 and 2.
Figure 5:
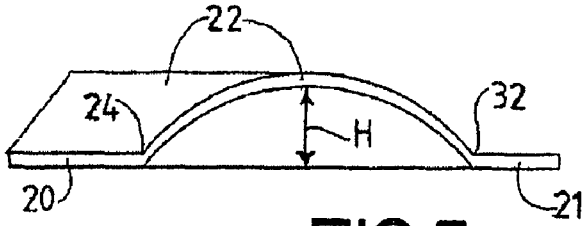
FIG. 5 shows a detail of the diaphragm according to FIGS. 3 and 4, said detail being encircled at V in FIG. 3.

In the diaphragm 6 according to FIGS. 3, 4 and 5, the design is advantageously selected such that the mean inner radius value r of each inner corner region 35, 36, 37, 38 is smaller than the mean outer radius value R of the opposite outer corner region 27, 28, 29, 30. In practice, a large range of values is available for selecting the inner radius values r and the outer radius values R. The values actually selected depend on a number of parameters, which differ depending on the design of the transducer and depending on the intended use of the transducer. As one example of a diaphragm developed by the Applicant and intended for actual future use, it may be mentioned that such a diaphragm has outer dimensions of 15 mm×11 mm and that the tunnel height H of the diaphragm intermediate region 22 is set at 3.5 mm and that the outer corner regions have an outer radius value R of 2.0 mm and the inner corner regions have an inner radius value r of 1.5 mm, so that the inner radius value r is three-quarters of the size of the outer radius value R.

The diaphragm 6 offers the advantages already mentioned above, namely increased stiffness of the diaphragm 6 in the region of the inner corner regions 35, 36, 37, 38 and a larger moving surface, which is critical for producing the generated sound pressure.

The invention claimed is

1. A diaphragm for an electroacoustic transducer, wherein the diaphragm has a diaphragm inner region and a diaphragm outer region and a diaphragm intermediate region which connects the diaphragm inner region and the diaphragm outer region, and wherein the diaphragm inner region is provided for converting between sound waves and electrical signals, and wherein the diaphragm outer region is provided for attaching the diaphragm, and wherein the diaphragm inner region is delimited toward the outside by a certain number of sides which adjoin the diaphragm intermediate region and between in each case two neighboring sides has a rounded outer corner region with a mean outer radius value R, and wherein the diaphragm outer region is delimited toward the inside by the same number of sides which adjoin the diaphragm intermediate region and between in each case two neighboring sides has a rounded inner corner region with a mean inner radius value r, and wherein each inner corner region lies opposite an outer corner region, and wherein the inner corner regions and the outer corner regions have the same direction of curvature, characterized in that, for the mean outer radius value R of an outer corner region, the mean inner radius value r of the opposite inner corner region lies in a range of values between $$R - \frac{R}{100} \text{ and } \frac{R}{100}.$$

2. A diaphragm as claimed in claim 1, wherein the mean inner radius value r has a value of $$R - \frac{R}{4}.$$

3. A diaphragm as claimed in claim 2, wherein four inner corner regions and four outer corner regions are provided.

4. A diaphragm as claimed in claim 3, wherein the sides which run between the inner corner regions and the outer corner regions are rectilinear.

5. A diaphragm as claimed in claim 1, wherein all the mean inner radius values r of the inner corner regions are the same size and wherein all the mean outer radius values R of the outer corner regions are the same size.

6. An electroacoustic transducer comprising a diaphragm, wherein the diaphragm has a diaphragm inner region and a diaphragm outer region and a diaphragm intermediate region which connects the diaphragm inner region and the diaphragm outer region, and wherein the diaphragm inner region is provided for converting between sound waves and electrical signals, and wherein the diaphragm outer region is provided for attaching the diaphragm, and wherein the diaphragm inner region is delimited toward the outside by a certain number of sides which adjoin the diaphragm intermediate region and between in each case two neighboring sides has a rounded outer corner region with a mean outer radius value R, and wherein the diaphragm outer region is delimited toward the inside by the same number of sides which adjoin the diaphragm intermediate region and between in each case two neighboring sides has a rounded inner corner region with a mean inner radius value r, and wherein each inner corner region lies opposite an outer corner region, and wherein the inner corner regions and the outer corner regions have the same direction of curvature, characterized in that, for the mean outer radius value R of an outer corner region, the mean inner radius value r of the opposite inner corner region lies in a range of values between $$R - \frac{R}{100} \text{ and } \frac{R}{100}.$$

7. An electroacoustic transducer as claimed in claim 6, wherein the electroacoustic transducer is designed as a loudspeaker.

* * * * *